United States Patent [19]

Benardelli

[11] Patent Number: 5,020,831

[45] Date of Patent: Jun. 4, 1991

[54] IMPRINTED PRODUCT WITH TAMPERPROOF SEAL METHOD OF PRODUCING PRODUCT

[75] Inventor: Giovanni Benardelli, Coldrerio, Switzerland

[73] Assignee: Arysearch Arylan AG, Vaduz, Liechtenstein

[21] Appl. No.: 397,520

[22] Filed: Aug. 23, 1989

[30] Foreign Application Priority Data

Dec. 23, 1988 [CH] Switzerland ..... 4769/88
Feb. 17, 1989 [CH] Switzerland ..... 548/89

[51] Int. Cl.[5] ..... B42D 15/00

[52] U.S. Cl. ..... 283/108; 283/72; 283/94; 283/81; 283/101

[58] Field of Search ..... 283/72, 81, 94, 95, 283/100, 101, 108, 901

[56] References Cited

U.S. PATENT DOCUMENTS

| | | | |
|---|---|---|---|
| 3,896,965 | 7/1975 | Cornell | 283/72 X |
| 4,184,701 | 1/1980 | Franklin et al. | 283/108 X |
| 4,228,425 | 10/1980 | Cooke | 283/108 X |
| 4,424,911 | 1/1984 | Resnick | 283/81 X |
| 4,557,505 | 12/1985 | Schaefer et al. | 283/94 X |
| 4,608,288 | 8/1986 | Spindler | 283/94 X |
| 4,709,396 | 11/1987 | Voshall et al. | 283/101 X |
| 4,880,256 | 11/1989 | Fere-Blanquez | 283/81 X |

FOREIGN PATENT DOCUMENTS

| | | | |
|---|---|---|---|
| 8603279 | 7/1988 | Netherlands | 283/108 |

*Primary Examiner*—Paul A. Bell
*Attorney, Agent, or Firm*—Scully, Scott, Murphy & Presser

[57] ABSTRACT

On a printing substrate an inking interlaced multilayer is coated which incorporates a latent configuration to be rendered visible as an actual irreversible image at any later moment by its transposal onto a new support, the obtained product being applicable as a protection against counterfeiting on commercial articles, packings, for publishing, advertising, certification purposes and so on. FIG. 6 shows an active label-seal in which the latent disc-shaped configuration is transposed from the printing substrate on the packing 12 provided as support, when the label-seal 13 is separated in stripping from said packing 12 off the closure line 14. FIG. 7 shows a counterfeiting-protective device in which the inking interlaced multilayer on substrate 18 representing a trademark and a countersign incorporates a latent configuration performing as an active seal 28 as X, capable of displaying the corresponding actual image on a new support when the printing substrate, after being adhesively fastened to the new support, is then detached from the same.

13 Claims, 4 Drawing Sheets

IMPRINTED PRODUCT WITH TAMPERPROOF SEAL METHOD OF PRODUCING PRODUCT

BACKGROUND OF THE INVENTION

1. Field of the Invention

The present invention relates to imprinted products applicable against counterfeiting and for other purposes, printable in typography, lithography or screen printing, also in combination, or by other technique and it also describes the process for obtaining said products.

2. Discussion of the prior art

The technique for preparing a graphic configuration on a substrate in view of its successive transfer to a new support, for instance for transferable letters and writings, is widely known. Naturally the graphic configuration is complete and visible on the substrate also before its transfer, which is applicable to the whole extent of the printed area. The transfer of the graphic configuration from the original substrate to a new support was produced by detaching the substrate from the new support bonded by means of an adhesive matter. In order to achieve the adhesion a high specific pressure had to be applied on the external face of the substrate, on which the graphic configuration had been sub-surface printed, with a suitable stylus and not without exposing the very image to the risk of tearing. It must be noted that the transfer to the new support was not constitutive of the image, which was perfectly defined and fully visible on the original substrate before separation.

It is known that counterfeiting is widely practised in the trade of vauable articles in various productive fields, such as for rare coins, stamps, gems and the like, and that it brings forth imitations having trademark, aspect and characteristics seemingly identical to those of the original articles, but being generally of lower quality, and of course of lower value since traded in an unlawful manner. As a protection against counterfeiting, original articles normally bear a reproduction in printing of the original trademark, which cannot provide a safeguard against counterfeiting, as such reproductions are easily duplicable and therefore fail to provide any security against copying and falsification.

One should therefore dispose of devices suitable to certify the authenticity of the imprinted emblems by means of valid seals capable of producing visual warning or alarm, information, sign and the like. One can also conceive the utility of a seal exposing the illicit opening of packings in the field of consumer products, or an alteration occurred on a document and the like, which seal only at the moment of being pulled off the protected article would produce a message or a warning until then invisible, thus practically leaving no chance to counterfeiting.

Such devices for the above and other general purposes could be embodied by an imprinted product which may be effectively capable of fulfilling the function of a seal.

SUMMARY OF THE INVENTION

An object of the present invention is to provide an imprinted product of the graphic industry, wherein on the substrate a decorative inking interlaced multilayer is present as selectively subdividable and incorporates another latent image, minor in area, of figurative, lexical or numeric nature, to be rendered irreversibly visible at any later moment by its transposal onto any new support under the pulling action of an adhesive layer, said imprinted product being applicable for controlling and certification purposes, for advertising and as a protection against counterfeiting on commercial articles, on all kind of industrial and consumer packings and the like.

Pursuant to the present invention there is provided an imprinted product, applicable against counterfeiting in defence of commercial articles, packings and the like, comprising a substrate and another support, the substrate being generally of transparent plastic sheeting, wherein on said substrate an inking interlaced multilayer incorporates an invisible inferior graphic configuration, that is latent but can be made visible at any later moment to display an actual irreversible image obtainable in sharp details from the precise subdivision of the inking multilayer when, after the complete adhesion of the imprinted substrate to a new support, it is transposed to the new support at their separation in response to the pulling action of the adhesive layer, the extent of the virtual latent configuration being confined within the area of said inking multilayer.

In view of a deferred application to a new support, the substrate is transitorily provided with silicone paper to protect the adhesive.

The invention comprises also an imprinted product applicable particularly as a counterfeiting-protective device for commercial articles, consisting of a creased transparent plastic tag, also tryptich-shaped, with its sides folding inwardly to mate edges and bond because of the intercoated adhesive, which tag presents at least an elongate hook lockable onto the article upon folding closed the tag, and forms with the inking an interlaced multilayer by sub-surface printing on one of said sides as a reproduction of the trademark and an encompassing countersign to impart thereto a tamperproof active seal, said inking multilayer anchoring on its substrate with only some predetermined portions and being subject to visible alteration and to the irreversible appearance of unexpected graphic elements upon the rupture of the countersign when the tag sides are opened in an attempt to loose the blocked hook.

When desired, the device may comprise a ticket bearing informative data, as for instance the quality specifications of the article. Such ticket is placed so as to be encompassed by the countersign imparted as an active seal and is therefore protected by the latter.

The combination of said device with a commercial article, for instance a fashion product, is effected by passing the relative elongate or extended hook preferably through form of a lace in any hole in the same article, for instance into the buttonhole of a garment.

The inking interlaced multilayer features a countersign that may consist of figures, writings, letters, lines, numbers or the like.

This security device in the form of a seal is fool-proof in the role of authentifying of the trademark and of certification of the informative data therein contained, as it is counterfeit-proof per se. The device is impossible to replicate due to the intrinsic properties of the security printing product thereon, but it can also bear a further induplicable printing subject as a hologram. In any case the inking interlaced multilayer featuring the trademark and the countersign, imparted as an active seal, is photostatically irreproducible.

The above counterfeiting-protective device may incorporate a signal to produce an optical alarm when the tag is stripped open, with the visible rupture of coloured inking bars set in non-anchored parallel lines beneath a transparent window and adhesively fastened to the substrate only at their extremities. Furthermore a computerized numbering method may be expediently adopted to mark each individual imprinted device of the same series with a progressive ordinal number. To this purpose an ink jet printer is used to imprint the number in inverse print on the sub-surface of the substrate preferably on the same transparent area where the coloured bars are then overset to protect the number against falsification. Essentially, as long as the device printing qualities remain intact, the authenticity of the trademark and the certification of quality data in the enclosed ticket remain protected with certainty.

It is impossible to reuse the device, as the block of inserted hook proves irreversible for the presence of the countersign as an active seal and of the further optical signals.

The top of the elongate hook to be locked on the article is anchor-shaped so that it gets blocked as soon as the tag is closed. When a counterfeiter attempts to loosen the inserted hook from the closed device, he must separate the bonded sides of the tag and is therefore compelled to activate the seal which is hidden in the countersign and the special optical signals, exposing the illicit action with the appearance of a warning or other readable information, until then hidden as virtual latent text.

In order to increase the level of protection, other security expedients may be adopted under secrecy as applicable from case to case. To the inking interlaced multilayer featuring the trademark and the countersign a secret optical code can be added, which is made with an ink invisible under white light and is only detectable under ultraviolet light.

Besides its application to commercial articles, said counterfeiting-protective device may find analogous certificative applications. For instance it may be adopted as an identification pass for participants to any convention, as in meetings, also of military nature, congresses, fairs and exhibitions and in view of this application the new identification pass is endowed of at least a free clip, not to be necessarily blocked.

An imprinted product pursuant to the invention in the form of a multipurpose adhesive active label-seal, generally on a substrate of plastic transparent material, cut in separate formats or supplied from a roll, may also be adopted, to expose the opening of packings, envelopes, documents and the like, all the latter acting as supports of generic type. The virtual latent configuration imprinted on the substrate can at any later moment disclose an actual irreversible image stamped by the subdivision of the inking interlaced multilayer, such as a warning or other text, legible when the active label-seal is separated in stripping from the packing, envelope, document or the like, provided as generic supports. Said label-seal may incorporate the signal to produce an optical alarm by means of the above described coloured inking bars. Furthermore each individual label-seal can be marked with a computer-generated progressive ordinal number preferably placed under the protection of said coloured inking bars.

A further object of the present invention is to provide a printing process to prepare the products imprinted with an inking interlaced multilayer, employing a printing substrate and another support to transfer a graphic subject, wherein at least on the substrate, generally a transparent plastic material, in formatted sheets or in roll form for a reel-to-reel printing operation, a non-anchorable transparent transfer primer ink is register-coated upon the area of an intended graphic configuration so as to construe with said primer a corresponding virtual latent image; the whole surface of the substrate is then coated with many inking layers finely screened to display a trademark and a surrounding countersign, the resulting inking multilayer being only in portions deemed to form at a later stage an actual irreversible image with the loosely anchored areas printed upon said primer; a transparent ink is overlaid and penetrates the inking multilayer screen so as to interlace with the inferior primer ink; a covering ink and then a pressure sensitive high-tack adhesive are applied; finally, after bonding the substrate also with mere finger pressure to the new support chosen between a sheet of plastic material and a generic support suitable to accept the adhesive matter, at their later separation a selective detachment of the inking interlaced multilayer non-anchored portions takes place with transposal of the latent graphic configuration into an actual image on the new support.

The support is in this description called "of generic type" when it is provided by the surface of any article, suitable to accept the adhesive matter, like the external face of a packing, on which the imprinted product is applied to protect, for instance, the closure.

In case the whole inking multilayer is reassembled again by the superposition of the substrate onto the newly produced image on the support, the whole countersign is visible again but the area and edges of the newly produced image nevertheless remain distinguishable for a difference in chromatic tone, due to an optical gap in levels from the surrounding inked surfaces which belong to a lower plane, as they adhere to the original substrate.

The image transposal in between the substrate and a support, brought forth by the selective splitting exerted by the adhesive layer, can be reciprocal when the adhesive is coated not as a continuous film but on separate zones only, each zone individually backing a graphic configuration to be exchanged between substrate and support.

The expression "active seal" pursuant to the present invention relates to the imprinted countersign, as it incorporates a latent configuration that can produce by transposal on a new support an unexpected irreversible image, e.g. a written warning or the like, the countersign thus performing to a greater and more evident extent the function of a seal. The term "anchored" defines a chemical or physical union between the inking multilayer and the substrate without any adhesives. Furthermore the expression "transfer primer ink" is defined as a layer of a lithographic or screen printing ink or varnish, which renders overlaid inks transposable. The adoption of a pressure sensitive high-tack adhesive matter permits to obtain the complete adhesion of the substrate to the support, also with finger pressure if allowed by the overall dimensions. It follows that at the separation of the substrate from the support the portions of the inking interlaced multilayer which are overlaid on the primer are selectively transposed on the support by virtue of the high tack of the adhesive film.

As substrate may be employed a calendered or extruded sheet of transparent or opaque plastic material selected from the group comprising polyvinil chloride, polycarbonate, polystyrol, polyesther, polypropylene, or of cellulose acetate. Also paper, cardboard and the like may be employed, preferably with a glossy smooth surface. The non-anchorable primer is a transparent ink chosen in connection with the material on which it is applied. Said primer in fact must not link or anchor to the substrate, but after printing pursuant to the process of the present invention it must form an easily delaminable film. The transparent ink constituting the primer is chosen according to the nature of the substrate, and can be based on cellulosic constituents, synthetic wax, silicones, paraffin, non oxidizing oils in a suitable solvent, for instance a glycolic solvent, in presence of a plasticizer. On the inking interlaced multilayer, before applying the adhesive layer, a transparent ink is coated and thereupon a covering ink, if desired. The inking multilayer is obtained by the superposition of different ink coatings chosen for the reciprocal chemico-physical stability. In fact in spite of the superposition of several inking layers each ink must keep in time both the original properties, and the appropriate chemico-physical relation with the next layers. Between the top layer and the bottom one, which interlace through the screen holes present in the middle inking layers, a permanent bond is formed capable of severing the middle layers package into neat areas under the pulling action of an overlaid adhesive.

The transparent layer, applied preferably from screen printing, is made of an ink usually of nitro-cellulose in a solvent and in presence of a plasticizer. In the first place said transparent layer forms a levelled and continous surface on the inking multilayer, which per se may show an irregular surface because of screen holes. Further, by applying said transparent coat on the inking multilayer, it occurs that it seeps in the multilayer screen and thus it reaches the primer with which it links due to chemico-physical affinity. By virtue of said seepage a mechanical connection is formed between the transparent layer and the primer which guarantees the indivisibility of the inking layers locally superposed to the primer under the pulling action of the adhesive on said inking interlaced multilayer. The covering ink which may be coated upon the transparent ink is a screen printing ink made of a suitable pigment, generally titanium bioxide, in presence of a plasticizer and of a solvent compatible with those used for the primer and for the transparent ink. Said covering layer has the function of masking to a visual observation the shape of the latent graphic configuration defined by means of the primer, and after the image display it constitutes the background on which the image is made actually visible. It is possible to prepare a balanced mixture of the inks to compound said two layers, care being taken to obtain a suitable degree of mechanical resistance to the pulling action of the adhesive and a convenient covering degree.

As adhesive matter a screen printable glue may be advantageously adopted, based for instance on synthetic rubber in a solvent, pressure sensitive and characterized by a high tack. A thin adhesive film is to be obtained and yet more resistant than the inking interlaced multilayer so that it may retain and draw the entire covering layer and the entire transparent layer with itself, while the inking multilayer forming the graphic image is selectively transposed with the exact profiles of the configuration defined by means of the primer.

The support consists of a sheet of plastic material or of another generic material suitable to accept the adhesive.

BRIEF DESCRIPTION OF THE DRAWINGS

The present invention may be more clearly understood by means of the following description with reference to the accompanying drawings in which.

DETAILED DESCRIPTION

Figure 1:
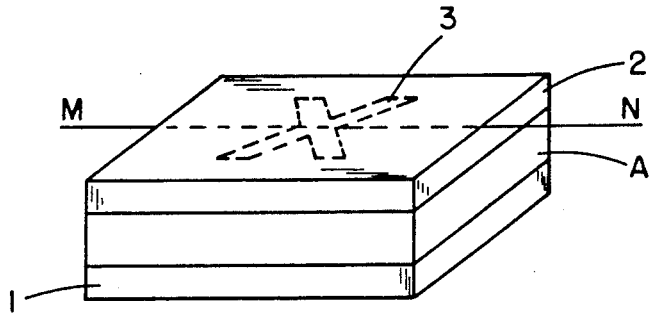
FIG. 1 shows a perspective view of the imprinted product made of the united substrate and support comprising an inking interlaced multilayer according to the present invention.
Figure 2:
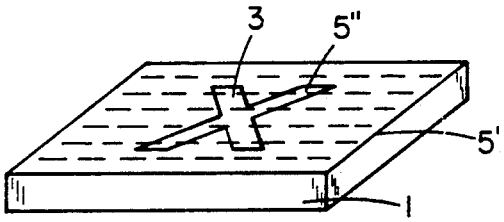
FIG. 2 shows a perspective view of substrate bearing the primer in the form of an X as a virtual latent image.
Figure 3:
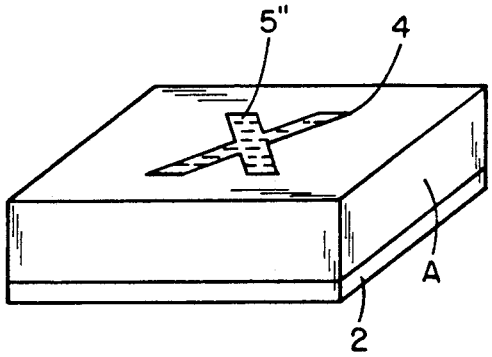
FIG. 3 shows a perspective view of the support upset off the the substrate with the actual image of the X.
Figure 4:
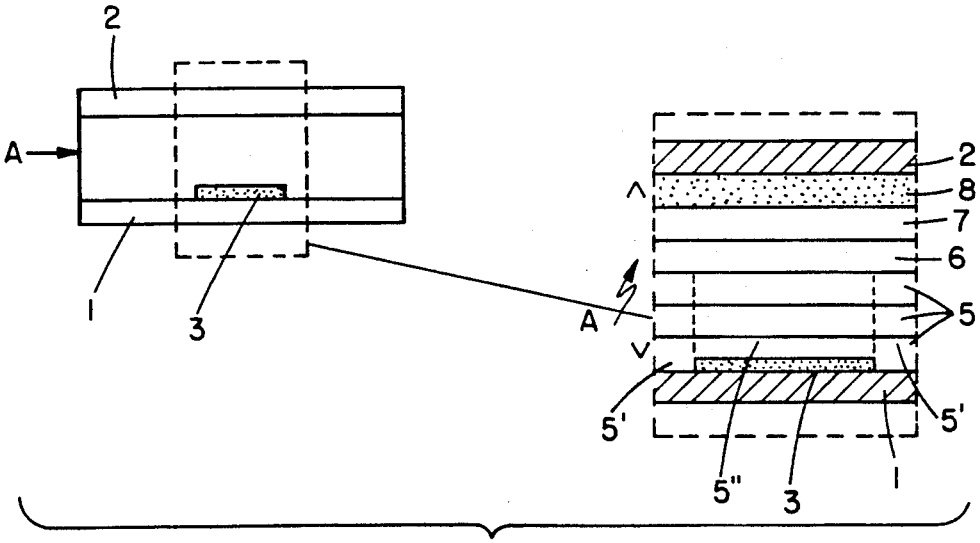
FIG. 4 shows a view of a longitudinal section along the plane M—N of FIG. 1 with a enlarged particular.

As in FIG. 1 the imprinted product shows a transparent substrate 1, a layer complex A, more precisely defined below, and a support 2 laid upon said complex. FIG. 2 shows the substrate 1 coated with the primer 3 to represent letter X as a virtual latent configuration. FIG. 3 shows the support 2 upset, separated from the substrate 1 and carrying the displayed actual image 4, which in this case is formed by the visible letter X. Said displayed image 4 is constituted by the non-anchored detached part of the inking interlaced multilayer which for the remaining part is anchored to substrate 1 for the absence of the primer. In fact, on support 2 the layers are now transposed which together with the portions of the inking multilayer constituting the displayed actual image 4, are parts of the complex A and before the separation from support 2 were on substrate 1. All this appears clearly from FIG. 4 showing the substrate and the support in longitudinal section with a detail in an enlarged scale. The complex of layer A is comprised between the substrate 1, on which primer 3 is coated, and support 2. Said complex A is formed by inking multilayer 5 interlaced with inferior primer 3 and with transparent layer 6 and with above covering layer 7 and adhesive layer 8, the latter spreading on support 2. In direct contact with substrate 1 inking multilayer 5 has the anchored portion of the inking layer 5' while the portion 5'' superposed to the primer 3 is not anchored and subject to detachment and transposal on support 2 to form the actual image 4.

In view of assembling support 1 to substrate 2 the adhesive layer 8 is protected with a silicone paper.

Upon detaching substrate 1 from support 2 the adhesive pulls on support 2 layers 6, 7 and 8 as well as non-achored portion 5'' of the inking multilayer 5, superposed to primer 3 on substrate 1, but cannot detach portion 5' anchored on the substrate. Non-anchored portion 5'' selected and transposed on support 2 forms the actual image 4 as obtained from the inking interlaced multilayer.

Figure 5:
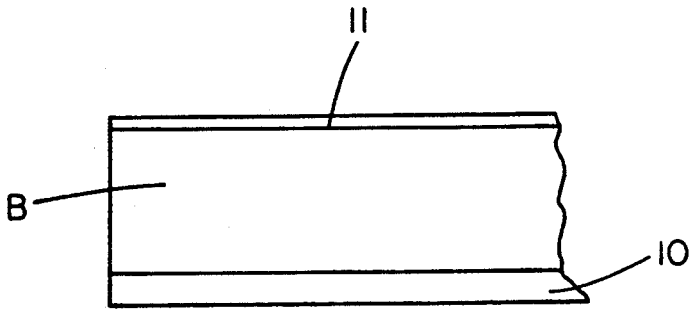
FIG. 5 shows a side view of an imprinted product in the form of an active label-seal as a security device for the protection of a closure.
Figure 6:
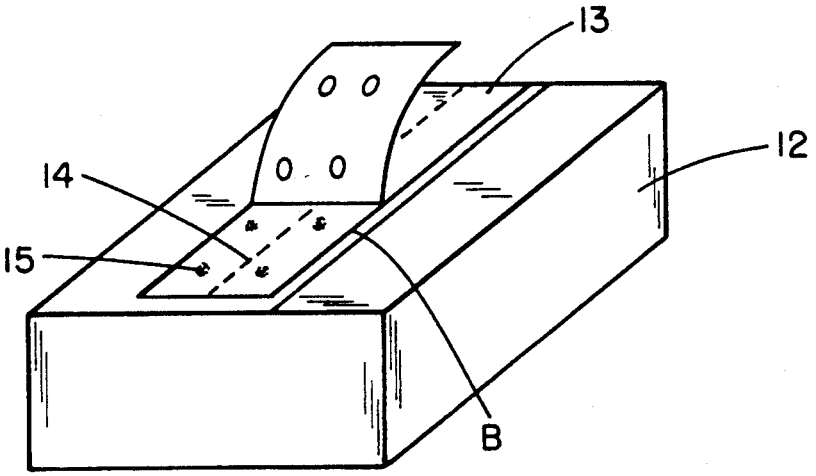
FIG. 6 shows the active label-seal applied to a generic support, that is on a cardboard packing.

FIG. 5 shows an adhesive active label-seal, consisting of a substrate 10 of plastic sheet, of a complex of layers B, including the adhesive layer on top (not shown), said complex being identical to complex A of above, with the protective paper 11. FIG. 6 shows a cardboard packing 12 with the active label-seal 13, in part detached from the closure line 14, thus exposing disc 15 detached from the label 13 and, as an actual image, transposed on the packing provided as support.

Figure 8:
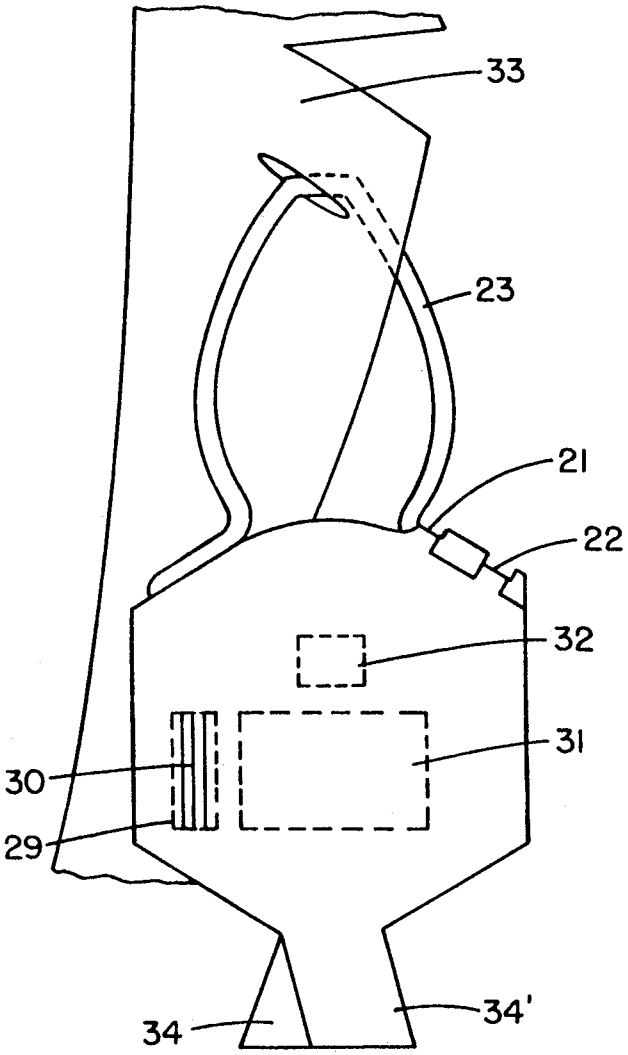
FIG. 8 shows a top view of the device of FIG. 7 closed and with the prolonged hook locked to an article of clothing.
Figure 7:
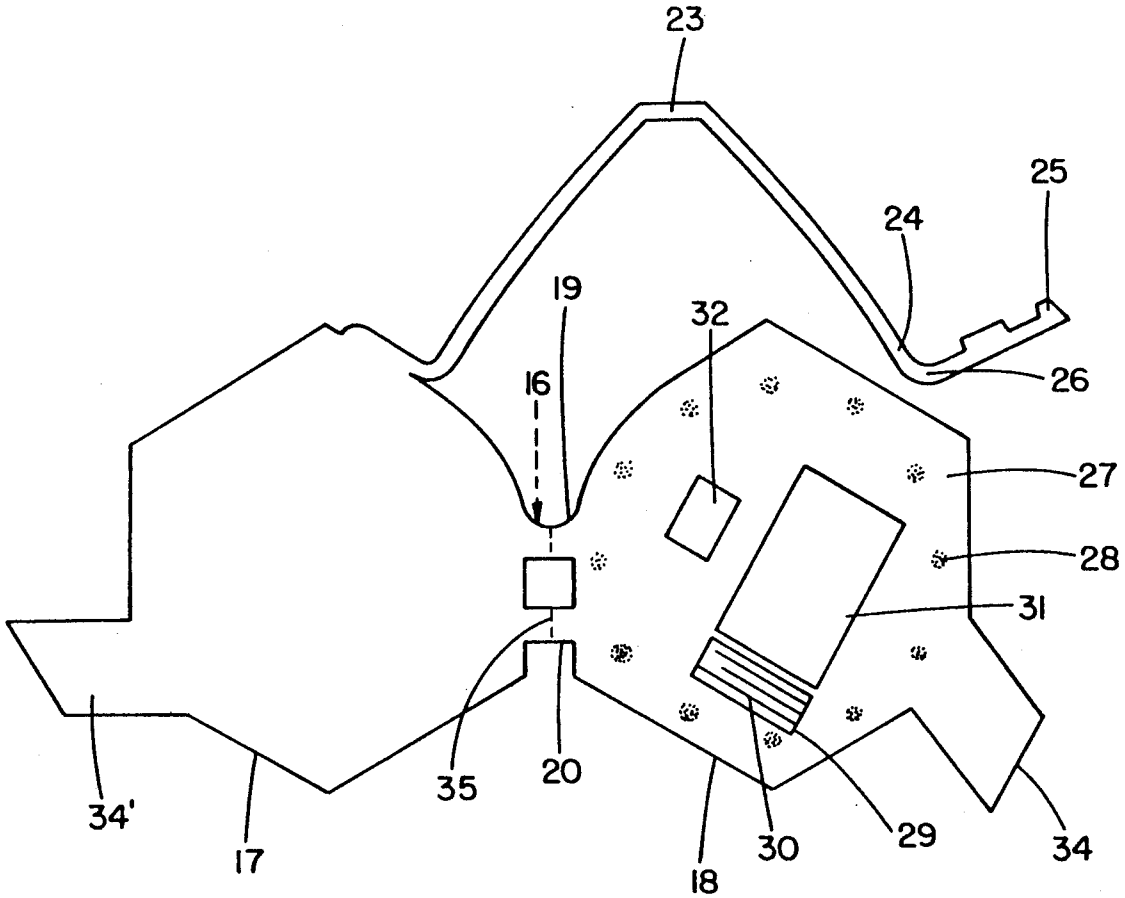
FIG. 7 shows a top view of an imprinted product as a counterfeiting-protective device in the form of a tag with two open sides.

FIGS. 7 and 8 show an imprinted product in the form of a counterfeiting-protective tag 16 of transparent plastic material, folded into two sides 17 and 18. More precisely the two sides are connected by the small bridges 19 and 20, which close in the device along line 35, that is bonded by means of an interposed adhesive, and form the holes 21 and 22. From tag 16 a prolonged hook 23 is formed of which the free extremity 24 is shaped as an elbow 26. The free top 25 of said lace is formed as an anchor. On side 18 of the open tag, precisely on its sub-surface, an inking interlaced multilayer 27 is visible representing a countersign 28 imparted as an active seal. Said countersign features a succession of stars. On the same side 18, said inking multilayer features a trademark 31 for the article on sale. A hologram 32 may be also applied to the device. With 29 a signal is indicated which produces an optical alarm when the detachment of the upper side causes the visible rupture of coloured inking bars 30, set in non-anchored parallel lines beneath a transparent window and adhered only at the extremities.

The trademark, the countersign, the optical signal and the hologram are visible by transparency from the external face of the sides. FIG. 7 shows the open device. Hook 23 is connected to the article, for instance to a suit 33. More precisely against top 25 of hook 23, the device is closed by superposing and uniting its two sides. Said top 25 in the form of an anchor is thus blocked by the holes 21 and 22 formed by the small bridges 19 and 20. With 34 and 34' are indicated two little tongues extending respectively from sides 18 and 17 and having position and shape such as not to coincide entirely in superposition. Said tongues help opening the device when the commercial article is sold. On the entire sub-surface of sides 17 and 18, that is on the surfaces in view in FIG. 7 a transparent adhesive is applied, not represented in said figure.

Figure 10:
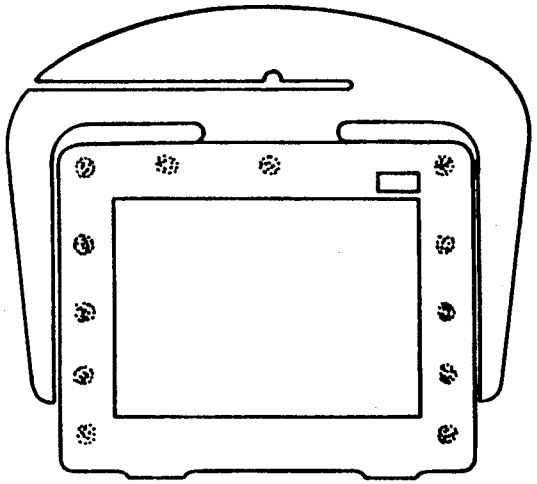
FIG. 10 shows the imprinted product of FIG. 9 folded closed.
Figure 9:
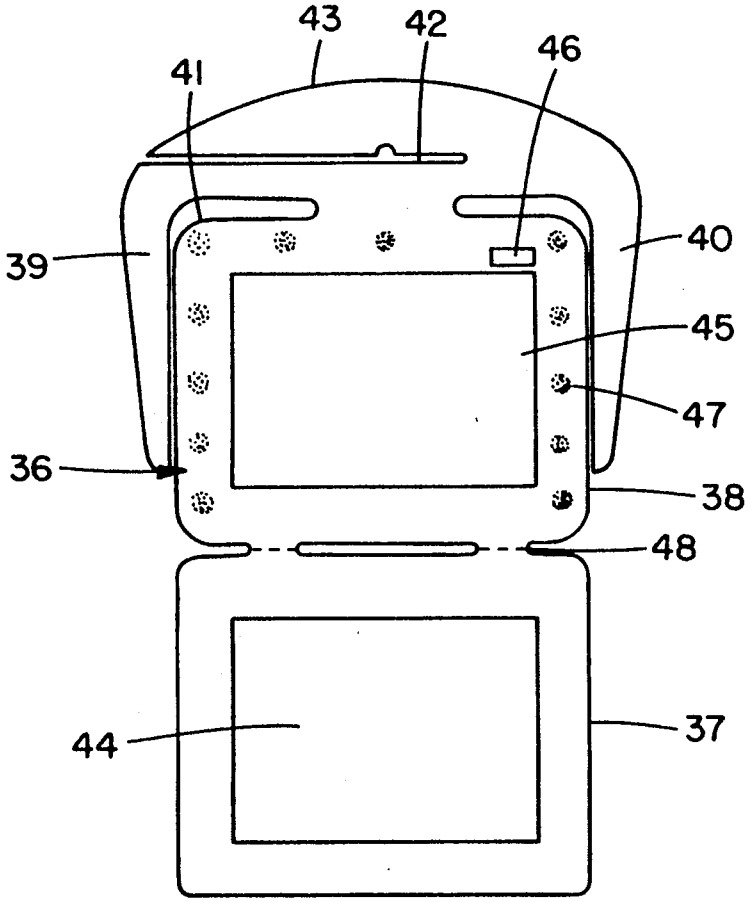
FIG. 9 shows an imprinted product in the form of a counterfeiting-protective device to be worn as a pass, which is open.

In case of an attempt to loosen or detach the blocked elongate hook trademark and the countersign in the form of a series of stars are subject to an alteration, also causes the appearence of new writings following the rupture of the active seal, while the bars 30 of the signal 29 detach and break. The FIG. 8 shows the closed device connected to an article 33. Said device has evidently not been tampered with also because it shows the signal 29 intact with the bars 30 regularly parallel. The FIG. 9 represents a security device in the form of a pass to be worn by the participant of any convention. As this figure shows, the device to be worn in form of a pass presents two extended appendices 39 and 40 extending or projecting from line 41 of the side 38 of the tag 36 in a particular concurrent way serving as clips for instance on the edge of the upper pocket of the jacket. If desired, a third appendix 43 extending from the transversal edge 42 of appendix 39 and crosses the latter. Also this third appendix helps as a clip and operates in the transversal orientation. For all other characteristics the pass at FIG. 9 is analogous to the device shown in FIG. 7 and 8. More precisely, with 44 the ticket for the personal identity data is indicated centered in the device, while with 45 and 46 respectively the corporative emblem represented by an inking multilayer and the hologram are shown. On the sub-surface of side 38 an inking interlaced multilayer represents a countersign 37 in the form of a succession of stars. Naturally the pass is closed by folding sides 37 and 38 along line 48 as shown at FIG. 10 by means of an adhesive.

While there has been shown and described what are considered to be preferred embodiments of the invention, it will of course be understood that various modifications and changes in form or detail could readily be made without departing from the spirit of the invention. It is therefore intended that the invention be not limited to the exact form and detail therein shown and described, nor to anything less than the whole of the invention herein disclosed as hereinafter claimed.

What is claimed is:

1. Imprinted product for the subsequent visible display of a latent message-representing image, for controlling and certification, advertising and security against counterfeiting of commercial articles, documents, industrial and consumer packaging; comprising:

(a) a substrate constituted of a transparent plastic sheet;

(b) a discontinuous non-anchorable layer of a transparent non-detachable transfer primer on said sheet for defining an invisible graphic configuration which is latent and unpredictable in configuration;

(c) a continuous decorative interlaced inking multilayer which is selectively subdividable being provided on said substrate and primer, said inking multilayer having intermittent portions anchored to said substrate, and remaining portions being loosely anchored to said discontinuous non-anchorable primer layer;

(d) said discontinuous primer layer being smaller in area than the area of said continuous interlaced inking multilayer and being interlaced with said multilayer;

(e) an ordinal reference number sub-surface printed in an inverse print, and non-repeatable within the same series of numbers on a transparent area of the substrate;

(f) a plurality of colored breakable inking bars, for the producing of an optical alarm set in a sub-surface in non-anchored parallel lines and adhesively fastened at the extremities thereof to said transparent area of the substrate, said bars contacting and safeguarding the number against counterfeiting;

(g) an adhesive layer coated in register, whereby upon a single use of said individual imprinted product and attachment to a new support, said non-detectable graphic configuration is renderable visible subsequently upon separation of the two supports and generates an actual irreversible image in sharp detail, through the precise subdivision of said inking multilayer in register with said latent image through extraction and transposal of said part together with the primer of the latent image to the new support in response to a pulling action by the adhesive layer so that an irreversible rupture of said inking bars takes place to produce an optical alarm display.

2. Imprinted product as claimed in claim 1, comprising a creased tryptich-shaped transparent plastic tag having sides folded inwardly into mating edges and bonded by said adhesive, said tag including at least one elongate hook lockable to a commerical article upon folding the tag closed, and forming with the inking interlaced multilayer through sub-surface printing on one of said sides a reproduction of a trademark and an encompassing countersign to provide a tamperproof active seal, said inking multilayer being anchored to said substrate at only predetermined portions thereof and being subject to visible alteration and to an irrersible appearance of unexpected graphic elements upon the rupture of the countersign when the tag sides are opened in an attempt to loosen said hook.

3. Imprinted product as claimed in claim 2, comprising a ticket bearing informative data relative the article, said ticket being encompassed and protected by the countersign in the form of an active seal.

4. Imprinted product as claimed in claim 2, wherein the top of the hook is anchor-shaped so as to be locked within the closed tag.

5. Imprinted product as claimed in claim 2, comprising a tamperproof pass for personal identification including a free clip.

6. Imprinted product as claimed in claim 1, comprising a label seal on a substrate of plastic transparent material cut in separate formats or supplied in a roll for exposing the unlawful opening of packings, envelopes, documents as claimed in claim 1, wherein the virtual latent configuration imprinted on the substrate subsequently produces an irreversible actual image stamped by the subdivision of the inking interlaced multilayer, such as a warning or other legible text, upon the active label-seal being separated in stripping from the packing, envelope, document constituting a support.

7. Imprinted product as claimed in claim 1, wherein the interlaced inking multilayer incorporates a countersign selected from figures, signs, writings, letters or numbers.

8. Imprinted product as claimed in claim 1, comprising incorporating a secret optical code in an ink invisible under white light and only detectable under ultraviolet light.

9. Printing process for preparing an interlaced inking multilayer imprinted product for controlling and certification, advertising and security against counterfeiting of commercial articles, documents, industrial and commercial packaging; including a printing substrate and a support to transfer a printing substrate and a support to transfer a graphic subject; comprising register-coating on at least the substrate, such as a plastic transparent material in formatted sheets or in roll form for a reel-to-reel printing operation, a non-anchorable transparent transfer primer ink on the area of an intended graphic configuration so as to produce with a primer a corresponding virtual latent image; coating the whole surface of the substrate with a multiplicity of inking layers which are finely screened to display a trademark and a surrounding countersign, a resultant inking multilayer only in portions thereof subsequently forming an actual image with the loosely anchored areas printed upon said primer; overlanging a transparent ink so as to penetrate the inking multilayer screen and to interlace with the inferior primer ink, applying a covering ink; printing sub-surface an unrepeatable ordinal reference number in inverse print on a transparent area of the substrate through a computer-controlled jet printer; forming on the same area a plurality of breakable colored ink bars area so as to contact said number, said bars being in non-anchored parallel lines and adhesively fastened to said sub-surface at only the extremities thereof; applying a pressure-sensitive high tack adhesive, after bonding the substrate with finger pressure to the support selected between a sheet of plastic material and a support of a generic type, whereby responsive to a subsequent separation, in addition to the rupture of the bars, a selective extraction and transposal of the interlaced inking multilayer non-anchored portions coherent to the latent graphic configuration produces an actual irreversible visible image on the support.

10. Process as claimed in claim 9, wherein the image transposal between the substrate and the support, rendered visible by the selective separation exerted through the adhesive layer is reciprocal wherein the advise is coated on only separate zones, each said zone individually backing a graphic configuration which is to be exchanged between said substrate and support.

11. Process as claimed in claim 9, wherein the primer is a transparent ink non-anchorable to the substrate and selected from material consisting of cellulose constituents, synthetic wax, silicone, paraffin, and non-oxidizing oils.

12. Process as claimed in claim 9, wherein said inking multilayer is obtained by the superposition of different ink coatings selected for reciprocal chemico-physical stability so that each maintains the original properties thereof and a chemico-physical relation with the subsequent layers, and wherein between the top layer and the bottom one, which interlace through the screen holes present in the middle layers, there is formed a permanent bond for enabling the severing the middle layers into specified areas under the pulling action of an overlaid adhesive.

13. Process as claimed in claim 9, wherein the transparent ink coated on the inking multilayer to form a transparent coating comprises a cellulose constituent.

* * * * *

UNITED STATES PATENT AND TRADEMARK OFFICE

CERTIFICATE OF CORRECTION

PATENT NO. : 5,020,831

DATED : June 4, 1991

INVENTOR(S) : Giovanni Benardelli

It is certified that error appears in the above-identified patent and that said Letters Patent is hereby corrected as shown below:

Column 1, line 32: "vauable" should read as --valuable--

Column 4, line 66: "polyvinil" should read as --polyvinyl--

Column 6, lines 65-66: "adhesive pulls" should read as --adhesive 8 contacting the latter pulls--

Column 6, line 66: "layers 6, 7 and 8" should read as --layers 6 and 7--

Column 7, line 54: "appearence" should read as --appearance--

Column 9, lines 12-13, Claim 2: "irrersible" should read as --irreversible--

UNITED STATES PATENT AND TRADEMARK OFFICE

CERTIFICATE OF CORRECTION

PATENT NO. : 5,020,831

DATED : June 4, 1991

INVENTOR(S) : Giovanni Benardelli

It is certified that error appears in the above-identified patent and that said Letters Patent is hereby corrected as shown below:

Column 10, line 9, Claim 9: "overlanging" should read as --overhanging--

Signed and Sealed this

Twenty-sixth Day of January, 1993

*Attest:*

STEPHEN G. KUNIN

*Attesting Officer*

*Acting Commissioner of Patents and Trademarks*